US007077949B2

(12) United States Patent
Bakker et al.

(10) Patent No.: US 7,077,949 B2
(45) Date of Patent: Jul. 18, 2006

(54) FCC REACTOR VESSEL

(75) Inventors: Ernst Antonius Bakker, Amsterdam (NL); David John Bridger, Rosehill (AU); Hendricus Arien Dirkse, Amsterdam (NL); Stephen Brian Fowler, The Hague (NL)

(73) Assignee: Shell Oil Company, Houston, TX (US)

( * ) Notice: Subject to any disclaimer, the term of this patent is extended or adjusted under 35 U.S.C. 154(b) by 570 days.

(21) Appl. No.: 10/332,931

(22) PCT Filed: Jul. 10, 2001

(86) PCT No.: PCT/EP01/07937

§ 371 (c)(1),
(2), (4) Date: Jan. 14, 2003

(87) PCT Pub. No.: WO02/06425

PCT Pub. Date: Jan. 24, 2002

(65) Prior Publication Data

US 2003/0146132 A1 Aug. 7, 2003

(30) Foreign Application Priority Data

Jul. 14, 2000 (EP) ..... 00306003

(51) Int. Cl.
*C10G 11/00* (2006.01)
*B01J 8/08* (2006.01)

(52) U.S. Cl. ..... 208/113; 422/145; 422/147; 422/213; 422/214; 208/113; 208/48 R

(58) Field of Classification Search ..... 422/145, 422/147, 213, 214; 208/113, 48 R
See application file for complete search history.

(56) References Cited

U.S. PATENT DOCUMENTS

| | | | | |
|---|---|---|---|---|
| 4,404,095 | A | 9/1983 | Haddad et al. | |
| 4,961,863 | A | 10/1990 | Van Den Akker et al. | |
| 5,328,592 | A * | 7/1994 | Hedrick | 208/113 |
| 5,665,949 | A * | 9/1997 | Fusco et al. | 208/161 |

FOREIGN PATENT DOCUMENTS

| | | |
|---|---|---|
| DE | 18 10 593 | 6/1970 |
| DE | 24 19 184 | 11/1975 |

(Continued)

OTHER PUBLICATIONS

Joseph W. Wilson. "Fluid Catalytic Cracking Technology and Operations". PennWell Publish Co. Tulsa. 1997, pp. 104-112.

*Primary Examiner*—Walter D. Griffin
(74) *Attorney, Agent, or Firm*—Charles W. Stewart

(57) ABSTRACT

A fluidized catalytic cracking reactor vessel having at its upper end means to separate catalyst particles from an effluent of a dilute phase fluidized catalytic cracking reactor riser, which separation means are fluidly connected to the downstream part of the reactor riser, fluidly connected with means to discharge the cleaned reactor riser effluent from the vessel and fluidly connected to means to discharge the separated catalyst to the lower end of the vessel, the vessel further having at its lower end means to discharge catalyst from the reactor vessel, wherein (a) between the side wall of the vessel and the separation means a shield is present, resulting in an exterior space between the vessel wall and the shield and an interior space within the shield, wherein the interior space is in open communication with the lower end of the reactor vessel at its lower end and wherein the exterior space and interior space are fluidly connected by means of one or more openings; and (b) means are present to supply a gas poor in coke precursors to the exterior space.

8 Claims, 1 Drawing Sheet

FOREIGN PATENT DOCUMENTS

| | | |
|---|---|---|
| DE | 24 45 460 | 4/1976 |
| DE | 28 22 104 | 11/1979 |
| DE | 43 28 811 | 10/1994 |
| DE | 195 26 504 | 7/1996 |
| EP | 0 139 390 | 5/1985 |
| EP | 0 643 122 | 3/1995 |

* cited by examiner

FIGURE
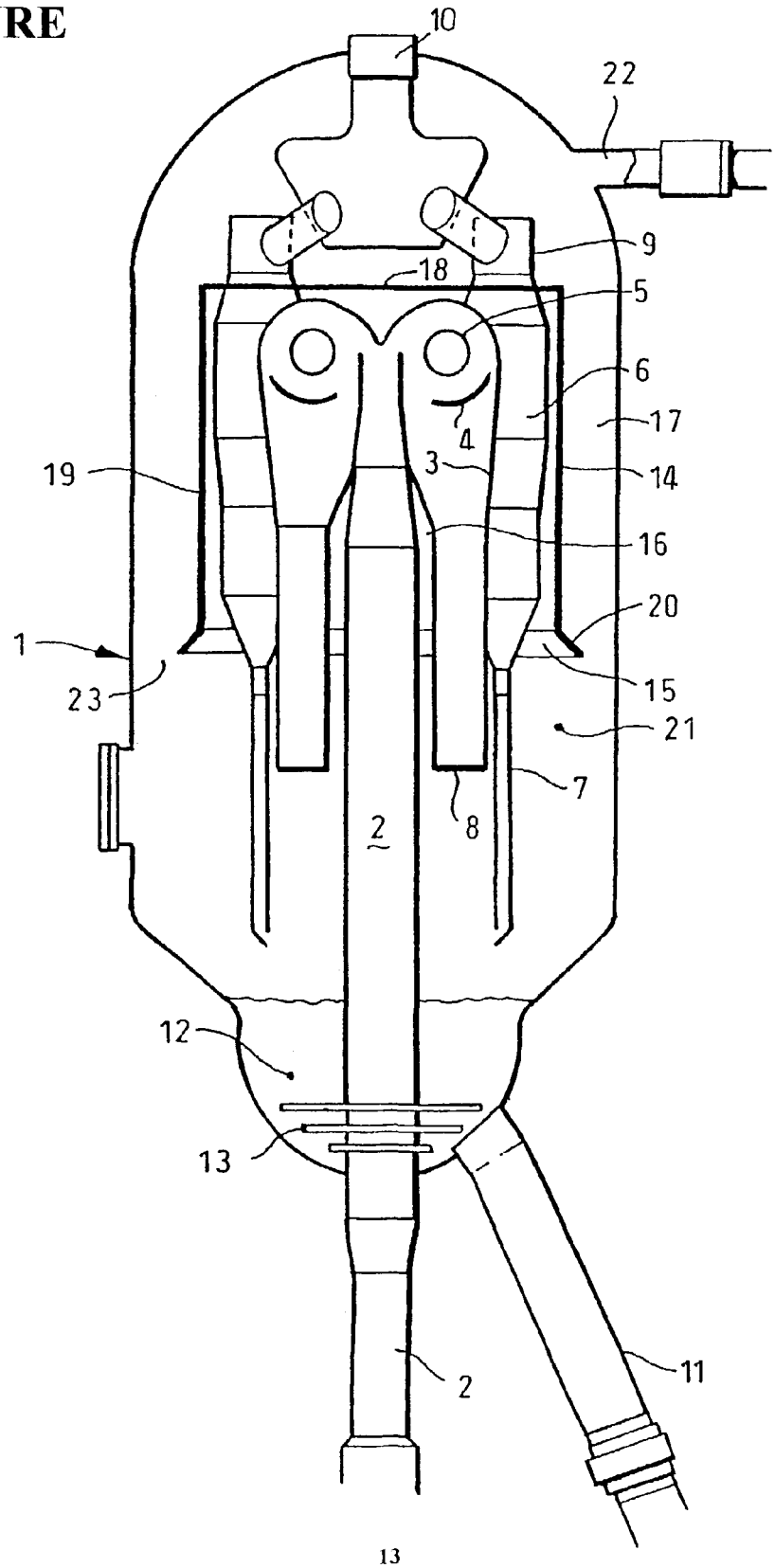

FCC REACTOR VESSEL

FIELD OF THE INVENTION

The invention is related to a fluidized catalytic cracking (FCC) reactor vessel comprising means to avoid the formation of coke on the surface of the vessel's internals and vessel walls. The invention is especially related to a method of retrofitting existing FCC reactor vessels such that a reactor vessel is obtained which, in use, will experience less coke formation on its internals and vessel walls.

BACKGROUND OF THE INVENTION

U.S. Pat. No. 4,961,863 describes an FCC reactor vessel comprising at its upper end cyclone means to separate catalyst particles from an effluent of a dilute phase fluidized catalytic cracking reactor riser, which cyclone means are fluidly connected to the downstream part of the reactor riser, fluidly connected with means to discharge the cleaned reactor riser effluent from the vessel and fluidly connected to dipleg means to discharge the separated catalyst to the lower end of the vessel. A secondary gas discharge opening will be present, generally between or after the separation means, to allow gasses present in the reactor vessel to be discharged from the reactor vessel together with the cleaned reactor riser effluent. Such configurations wherein these means are fluidly connected, resulting in short contact times and low after cracking, are referred to as so-called closed-cyclone or close-coupled FCC reactor configurations.

In use coke tends to form on, for example, the surface of the separator means of an FCC reactor vessel of for example U.S. Pat. No. 4,961,863. This is especially the case when an FCC unit is operating on a more heavier feedstock than it was designed for. This is because small amounts of coke precursors, for example heavy hydrocarbons, are not fully separated from the catalysts in the separation means. When these small amounts of coke precursors together with the catalyst and are discharged to the lower end of the reactor vessel they will almost immediately separate from the catalyst and flow upwardly in the reactor vessel. Coke will form when these coke precursors come into contact with the hot exterior of for example the separator means.

The problem of excessive coke formation is especially a problem when processing heavy feedstocks in FCC reactor vessels which have been modified from a conventional non-close coupled design into the so-called close-coupled design. If the coke formation reaches a certain level large fragments of coke can to drop down into the lower end of the reactor vessel. These large coke fragments can in turn cause blockage of the means to discharge catalysts from the reactor vessel. Due to such blockage the FCC unit will have to be shut down in order to remove the blockage. It has been experienced that such unscheduled shutdowns occurred already after 1 to 2 years of operations. This is very disadvantageous. Especially considering the fact that an FCC unit is supposed to operate without an unscheduled shut down for many years, for example 4 years.

SUMMARY OF THE INVENTION

It is the object of the present invention to provide an FCC reactor vessel which, when in use, can be operated for a prolonged time in the absence of unscheduled shut downs due to the above described coking problems.

BRIEF DESCRIPTION OR THE DRAWING

The FIGURE shows an embodiment of the fluidized catalytic cracking reactor vessel of the invention.

DETAILED DESCRIPTION OF THE INVENTION

The object is achieved with the following apparatus.

Fluidized catalytic cracking reactor vessel comprising at its upper end means to separate catalyst particles from an effluent of a dilute phase fluidized catalytic cracking reactor riser, which separation means are fluidly connected to the downstream part of the reactor riser, fluidly connected with means to discharge the cleaned reactor riser effluent from the vessel and fluidly connected to means to discharge the separated catalyst to the lower end of the vessel, the vessel further comprising at its lower end means to discharge catalyst from the reactor vessel, wherein (a) between the side wall of the vessel and the separation means a shield is present, resulting in an exterior space between the vessel wall and the shield and an interior space within the shield, wherein the interior space is in open communication with the lower end of the reactor vessel at its lower end and wherein the exterior space and interior space are fluidly connected by means of one or more openings, and (b) means are present to supply a gas poor in coke precursors to the exterior space.

With the present apparatus according to the invention less coke formation is realised. Without wanting to be limited in any manner by the following theory it is believed that the reduction of coke formation is attributed to the fact that the coke precursors, which are discharged from the separator means to the lower end of the reactor vessel, cannot enter into the exterior space due to the over pressure realised by adding the additional gas poor in coke precursors. In this manner large stagnant zones, present in the exterior space, will contain significantly less coke precursors resulting in less coke formation.

The resulting flow path of the coke precursors from the lower end of the reactor vessel to the secondary gas discharge opening within the interior space will be shorter than in an apparatus without a shield. Thus a lower residence time of coke precursors will result and consequently also less coke will form in the interior space. Due to the presence of the shield more turbulence within the interior space will occur, thereby further reducing any coke formation.

The shield of the apparatus according to the invention is present between the side wall of the vessel and the separation means. The resulting interior space is in open communication with the lower end of the reactor vessel such that vapors, coke precursors and optional stripping gas present in the lower end of the vessel can freely enter the interior space from below. The exterior space is fluidly connected by means of one or more openings with the interior space. These openings can be present in the shield. Preferably this opening is formed by a space between the side wall of the reactor vessel and the lower end of the shield. In this configuration the shield and the side walls of the reactor vessel do not meet which is advantageous because of obvious constructional advantages. Because both exterior space and interior space are fluidly connected with the lower end of the reactor vessel, interior space and exterior space are fluidly connected according to this invention.

The shield may consist of a substantially vertical, i.e. tube or box like, wall extending from the roof of the vessel to a position at the lower end of the vessel and horizontally enclosing the separation means. Preferably the shield comprises tube like side walls and a roof, wherein the roof is positioned just above the separation means. This is advantageous because it reduces the volume of the interior space resulting in more turbulence and less residence time of the flow of coke precursors inside the interior space.

The additional gas poor in coke precursors which is added to the exterior spade will flow via the opening(s) in the shield into the interior space and into the secondary gas discharge opening. The velocity of the gas in these opening(s) in the shield should be sufficiently high in order to avoid coke precursors entering the exterior space from the lower end of the vessel. Preferably this gas velocity is between 1 to about 5 m/s and more preferably greater than 2 m/s. This gas velocity can be achieved by adjusting the volume of gas poor in coke precursors which is added to the exterior space and/or by adjusting the area of the openings in the shield. For example, a shield having an opening which opens into the lower end of the reactor vessel, as described above, can be advantageously modified by adding a lower shield section which is inclined towards the vessel side wall, thereby reducing the area of the annular (like) opening.

The separation means to separate the catalyst from the effluent of the dilute phase fluidized catalytic cracking reactor riser may be any means known to one skilled in the art. In particular reference is made to "Fluid catalytic cracking technology and operations", Joseph W. Wilson, PennWell Publishing Company, Tulsa, 1997, pages 104 to 112 which illustrates different separation means suitable for use in combination with the present invention. The separation means are preferably a combination of a primary and secondary separator. Suitably the primary separators are horizontal cyclone separators wherein the effluent is tangentially fed into a horizontally mounted cylinder. Such a horizontal cyclone separator or twin drum separator is for example described in the above mentioned U.S. Pat. No. 4,961,863. Another very suitable primary separator is a conventional vertical cyclone either provided with or without a dipleg. Vertical cyclones provided with a dipleg are the most commonly used primary separators in FCC processes as is illustrated in the above referred to general textbook. Vertical cyclones without a dipleg are for example described in EP-A-643122. Secondary separators are suitably a vertical cyclone or a swirl tube separator. Vertical cyclones provided with a dipleg are the most commonly used secondary separators in FCC processes as is illustrated in the above referred to general textbook.

In a commercial FCC process suitably more than one primary separator is fluidly connected to the downstream end of the dilute phase fluidized catalytic cracking reactor riser. In turn more than one secondary separator can be fluidly connected to one primary separator. This multitude of separators which can be present in the upper part of a reactor vessel results in a large exterior surface area on which coke formation can occur. By enclosing as much of this surface area with the shield according to the apparatus of the present invention a considerable smaller chance of coke formation will result as explained above.

The gas outlet of a primary separator may discharge the catalyst-poor gaseous effluent in the upper part of the interior space. This gas will enter a gas inlet opening of the secondary separator also located in the interior space. The gas inlet opening of the secondary cyclone will also serve as the secondary gas discharge opening.

Preferably the gas outlet conduit of the primary separator and the gas inlet conduit of the secondary separator are fluidly connected as in a closed-coupled FCC configuration. The secondary gas discharge opening as described above is suitably present in the conduit connecting the primary and secondary separators. Optionally the secondary gas discharge opening may be present in the gas outlet conduit of the secondary separator.

Preferably a stripping zone is present in the lower part of the reactor vessel. In this stripping zone the lower boiling hydrocarbons present in the catalyst as discharged into the lower vessel end are separated by contacting with a suitable stripping medium, preferably comprising steam, in a dense phase fluidized bed of catalyst. The stripping medium is the fluidizing medium of said fluidized bed. The stripping gas and the hydrocarbons enter the interior space to be discharged from the vessel via the secondary gas discharge opening. Optionally a separate stripping vessel may be present to further strip hydrocarbons from the catalyst obtained in the reactor vessel. This latter configuration is sometimes referred to as three vessel FCC configuration, the regenerator being the third vessel. In a three vessel configuration the gas poor in coke precursors, which is added to the exterior space, is preferably the stripping gas comprising hydrocarbons as obtained in the separate stripping vessel. It has been found that the content of coke precursors in this gas stream is sufficiently low in order to use the gas for this purpose.

Apart from the option as discussed for the three vessel configuration the gas poor in coke precursors can be any inert gas, for example nitrogen or low boiling hydrocarbons. Preferably steam is used.

The reactor vessel can be suitably used to process more heavy feeds. These heavy feeds are characterized in that they have a Conradson carbon of more than 1 wt % and wherein more than 40 vol % of its components have a boiling point of more than 475° C.

The invention is also directed to a method for retrofitting an existing fluidized catalytic cracking reactor vessel comprising at its upper end means to separate catalyst particles from an effluent of a dilute phase fluidized catalytic cracking reactor riser, means to discharge the cleaned reactor riser effluent from the vessel and means to discharge the separated catalyst to the lower end of the vessel and at its lower end means to discharge catalyst from the reactor vessel, wherein a shield is added to the existing reactor vessel in order to arrive at a reactor vessel as described above. Existing FCC reactor vessels, for example designed for a light feed, can advantageously be retrofitted with this simple method in order to arrive at an FCC unit which can handle more heavier feeds. Typical FCC processes which can be retrofitted with this method are for example described in the aforementioned general textbook pages 24 to 42. This method of retrofitting is especially advantageous because by adding a simple element, the shield, coke problems can be avoided without having to take more rigorous measures, like for example replacing the entire reactor vessel by a reactor especially designed for a heavier feed.

The invention shall be further illustrated by making use of the FIGURE.

The FIGURE shows a fluidized catalytic cracking reactor vessel 1 comprising at its upper end the downstream part of a dilute phase fluidized catalytic cracking reactor riser 2. To this downstream part 2 two primary horizontal cyclone separators 3 are shown. To these separators 3 the effluent is tangentially fed into a horizontally mounted cylinder 4. Once primary cyclone is fluidly connected to two secondary cyclones 6 of which only one is shown. The gas outlet openings 5 of the primary separators 3 is fluidly connected to the gas inlets (not shown) of secondary cyclones 6. The secondary cyclones 6 are vertical cyclones provided with a dipleg 7. The primary cyclones are also provided with a dipleg 8. The gas outlet 9 of the secondary cyclones are connected to a discharge conduit 10 through which the cleaned reactor riser effluent leaves the reactor vessel 1. In the conduit connecting the primary and secondary cyclone a secondary gas discharge opening is present (not shown) through which gas entering the interior space from below can be discharged from the reactor vessel via the gas outlet conduits 9 and 10. The reactor vessel 1 is further provided at its lower end with a conduit 11 to discharge catalyst from the reactor vessel to the stripping vessel (not shown). In the lower end of the reactor vessel 1 a stripping zone 12 is present provided with means 13 to supply stripping gas a fluidization medium. Around part or all of the separation means 3, 6 a shield 14 is present having an opening 15 at its lower end. The shield 14 has a flat roof 18, vertical walls 19 and an inclined lower wall section 20. The shield 14 encloses an interior space 16 from an exterior space 17. Both exterior and interior space are in communication with the lower end 21. A supply conduit 22 is present to supply gas poor in coke precursors from the separate stripping vessel (not shown) to the exterior space 17 via discharge opening 23 and flow via lower end 21 of the reactor vessel 1 and opening 15 to the interior space 16.

Preferably the gas outlet opening of conduit 22 is arranged such that the gas poor in coke tangentially enters the vessel 1. This is advantageous because a good mixing of gas poor in coke is achieved in the exterior space 17.

We claim:

1. A fluidized catalytic cracking reactor vessel comprising an upper end, a lower end and a side wall, wherein the upper end comprise:

means to separate catalyst particles from an effluent of a dilute phase fluidized catalytic cracking reactor riser to produce cleaned effluent, which separation means are fluidly connected to the reactor riser at a downstream location, fluidly connected with means to discharge the cleaned effluent from the vessel and fluidly connected to means to discharge the separated catalyst to the lower end of the vessel; and, the lower end comprises:

means to discharge catalyst from the reactor vessel wherein:

(a) between the side wall of the vessel and the separation means a shield is preset, resulting is an exterior space between the vessel wall and the shield and an interior space within the shield, wherein the interior space is in open communication with the lower end of the reactor vessel at its lower end and wherein the exterior space and interior space are fluidly connected by means of one or more openings; and (b) means are present to supply a gas poor in coke precursors to the exterior space.

2. The apparatus of claim 1, wherein the opening connecting the exterior space and the interior space is formed by an opening between the side wall of the reactor vessel and the lower end of the shield, which opening is open to the lower end of the reactor vessel.

3. A process for the fluidized catalytic cracking of hydrocarbon feedstock comprising:

passing the feedstock through a fluidized catalytic cracking reactor vessel comprising:

a upper end, a lower end and a side wall, wherein the upper end comprises:

means to separate catalyst particles from an effluent of a dilute phase fluidized catalytic cracking reactor riser to produce cleaned effluent, which separation means are fluidly connected to the reactor riser downstream location, fluidly connected with means to discharge the clean effluent from the vessel and fluidly connected to means to discharge the separated catalyst to the lower end of the vessel; and, the lower end comprises:

means to discharge catalyst from the reactor vessel wherein:

(a) between the side wall of the vessel and the separation means a shield is present, resulting in an exterior space between the vessel wall and the shield and an interior space within the shield, wherein the interior space is in open communication with the lower end of the reactor vessel at its lower end wherein the exterior space and interior space are fluidly connected by means of one more openings; and (b) means are present to supply a gas poor in coke precursors to the exterior space.

4. The process of claim 3 wherein the gas poor in coke precursors comprises stream or nitrogen.

5. The process of claim 3 wherein a gas stream from a separate stripping vessel is used as the gas poor in coke precursors.

6. The process of claim 3 wherein the gas velocity of the gas leaving the exterior space when passing the opening is greater 2 m/s.

7. The process of claim 3 wherein the feed to the fluidized cracking process has a Conradson carbon of more than 1 wt % and wherein more than 40 vol. % of its components have a boiling point of more than 475° C.

8. A process for retrofitting a fluidized catalytic cracking reactor vessel comprising:

an upper end, lower end and a side wall, wherein the upper end comprises;

means to separate catalyst particles from an effluent of a dilute phase fluidized catalytic cracking reactor riser to produce cleaned effluent, which separation means are fluidly connected to the reactor riser at a downstream location, fluidly connected with means to discharge the cleaned effluent from the vessel a fluidly connected to means to discharge the separated catalyst to the lower end of the vessel; and, the lower end comprises;

means to discharge catalyst from the reactor vessel;

said process comprising:

adding a shield in the reactor vessel between the side wall of the vessel and the separation means, resulting in an exterior space between the vessel wall and the shield and an interior space within the shield, wherein the interior space is in open communication with the lower end of the reactor vessel at its lower end and wherein the exterior space and interior space are fluidly connected by means of one or more openings; and means are present to supply a gas poor in coke precursors to the exterior space.

* * * * *